United States Patent [19]

Knobel et al.

[11] Patent Number: 5,032,308

[45] Date of Patent: Jul. 16, 1991

[54] LAYERED MIXED METAL HYDROXIDES IN ELECTRORHEOLOGICAL FLUIDS

[75] Inventors: Thomas M. Knobel, Hackensack, N.J.; Robert A. Cipriano, Lake Jackson, Tex.

[73] Assignee: The Dow Chemical Company, Midland, Mich.

[21] Appl. No.: 432,953

[22] Filed: Nov. 7, 1989

[51] Int. Cl.[5] ..... C10M 125/10; C09K 3/00

[52] U.S. Cl. ..... 252/74; 252/75; 252/76; 252/572

[58] Field of Search ..... 252/74, 75, 76, 572, 252/73

[56] References Cited

U.S. PATENT DOCUMENTS

| | | | |
|---|---|---|---|
| 4,033,892 | 7/1977 | Stangroom | 252/76 |
| 4,116,857 | 9/1978 | Lee et al. | 252/184 |
| 4,129,513 | 12/1978 | Stangroom | 252/78.1 |
| 4,183,900 | 1/1980 | Lee et al. | 423/157 |
| 4,243,555 | 1/1981 | Lee et al. | 502/159 |
| 4,326,961 | 4/1982 | Lee et al. | 210/683 |
| 4,392,979 | 7/1983 | Lee et al. | 252/184 |
| 4,483,788 | 11/1984 | Stangroom et al. | 252/578 |
| 4,502,973 | 3/1985 | Stangroom | 252/73 |
| 4,664,843 | 5/1987 | Burba, III et al. | 252/315.5 |
| 4,668,417 | 5/1987 | Goossens et al. | 252/75 |
| 4,687,589 | 8/1987 | Block et al. | 252/73 |
| 4,702,855 | 10/1987 | Goossens et al. | 252/75 |
| 4,744,914 | 5/1988 | Filisko et al. | 252/74 |
| 4,772,407 | 9/1988 | Carlson | 252/74 |
| 4,790,954 | 12/1988 | Burba, III et al. | 252/315.5 |
| 4,812,251 | 3/1989 | Stangroom | 252/75 |

FOREIGN PATENT DOCUMENTS 0207811 1/1987 European Pat. Off. .

OTHER PUBLICATIONS

CRC Handbook of Physics and Chemistry, 68th Edition 1987-88, pp. F-122, E-91, E-55, D-38, D-39, D-40, D-41, B-206.

Shulman et al., "The Electrorheological Effect and its Possible Uses," Jnl of Non-Newtonian Fluid Mechanics, vol. 8, pp. 29-41 (1981).

*Primary Examiner*—Paul Lieberman

*Assistant Examiner*—Christine A. Skane

[57] ABSTRACT

An electrorheological fluid wherein the discrete phase comprises a layered mixed metal hydroxide of the formulae:

$$Li_mD_dT(OH)_{(m+2d+3+na)}A_a^n \text{ and}$$

$$Mg_xAl_y(OH)_z$$

and the continuous phase is a low dielectric fluid. The layered mixed metal hydroxides may be functionalized with an aliphatic carboxylic acid or with the reaction product of a clay and an amine salt to provide a more dispersible particulate phase. The electrorheological fluids have improved thermal stability and provide a strong response to low electric field strengths while requiring a low concentration of layered mixed metal hydroxide component.

11 Claims, 5 Drawing Sheets

VISCOSITY AS A FUNCTION OF APPLIED FIELD

LAYERED MIXED METAL HYDROXIDES IN ELECTRORHEOLOGICAL FLUIDS

BACKGROUND OF THE INVENTION

1. Field of the Invention

This invention relates to electrorheological fluids, i.e. fluids which exhibit a significant change in flow properties when exposed to an electric field. These fluids are also known as "electric field responsive fluids," "electro-viscous fluids" or "jammy fluids."

2. Background

Early studies of electrorheological fluids (ERFs) were performed by W. M. Winslow who demonstrated that certain suspension of solids (the "discrete," "dispersed" or "discontinuous" phase) in liquids (the "continuous" phase) show large, reversible electrorheological effects. These effects are generally as follows: in the absence of an electric field, electrorheological fluids exhibit Newtonian flow properties; specifically, the shear stress (applied force per unit area) is directly proportional to the shear rate applied (relative velocity per unit thickness). When an electric field is applied, a yield stress phenomenon appears and no shearing takes place until the shear stress exceeds a minimum yield value which increases with increasing field strength, i.e. the fluid appears to behave like a Bingham plastic. This phenomenon appears as an increase in apparent viscosity of several, and indeed many, orders of magnitude.

Electrorheological fluids change their characteristics very rapidly when electric fields are applied or released, typical response times being on the order of 1 millisecond. The ability of electrorheological fluids to respond rapidly to electric signals make them uniquely suited for use as elements in electro-mechanical devices. Often, the frequency range of a mechanical device can be greatly expanded by using an electrorheological fluid element rather than an electro-mechanical element having a response time which is limited by the inertia of moving mechanical parts. Therefore, electrorheological fluids offer important advantages in a variety of mechanical systems, particularly in those which require a rapid response between electronic controls and mechanical devices.

A range of devices have been proposed to take advantage of the electrorheological effect. Because of the potential for providing a rapid response interface between electronic controls and mechanical devices, it has been suggested that these fluids be applied in a variety of mechanical systems such as electro-mechanical clutches, fluid-filled engine mounts, high speed valves with no moving parts, and active dampers for vibration control, among others.

A wide range of combinations of liquids and suspended solids have demonstrated electrorheological effects. The basic ingredients of prior art electrorheological fluids are fine dielectric particles, the surfaces of which typically contain adsorbed water or some other surfactant or both, suspended in a non-polar dielectric fluid having a permittivity of less than that of the particle and a high breakdown strength. As used herein, the term "dielectric" refers to substances having very low electrical conductivity. Such substances have conductivities of less than $1\times10^{-6}$ mho per centimeter. These are general system requirements and accordingly a variety of systems have been found to demonstrate electrorheological effects.

While a number of theories have been proposed to explain the electrorheological effect, a comprehensive theory explaining all of the observed phenomenon has not yet been developed. However, those of ordinary skill in the art are aware that certain system parameters affect the electrorheological response of any given electrorheological fluid. These parameters include, amongst others, the size and concentration of the particles (or discrete phase), the polarizability of the particles, the aspect ratio of the particles in the electric field, the particle surface area, the particle solubility or dispersibility in the continuous phase, the particle porosity and adsorbed moisture, presence of surface activators and surfactants, the rate of shear, the electrorheological fluid temperature and the strength o the applied electric field.

While it is known that the continuous phase should be hydrophobic, experimental evidence suggests that the electrorheological effect is related to water adsorbed to the solid particles or discrete phase. Consequently, early and, indeed, many currently proposed electrorheological fluids include adsorbed water in the discrete phase. For example, U.S. Pat. No. 4,483,788 to Stangroom et al relates to electrorheological fluids comprised of a water-containing polymer such as phenol-formaldehyde polymer as the discrete phase and an oleaginous hydrophobic fluid as the continuous phase. It is specified that a discrete phase content of 25–35% by volume is preferred. However, the electrorheological effect of these fluids using polymers as the discrete phase is limited by the extent of polarizability of the polymeric molecules, the aspect ratio of the polymer in the electric field, the particle size of the polymer, its surface area and the dispersibility of the polymer in the continuous phase.

The scope for practical application of adsorbed water-dependent electrorheological fluids is, however, limited since many devices in which such fluids may be of use are more desirably operated at relatively high operating temperatures and relatively high electric field strengths.

Some efforts have been directed toward developing electrorheological fluids which do not rely upon the presence of adsorbed or free water and which require relatively low electric field strengths. For example, U.S. Pat. No. 4,722,407 to Carlson discloses an electrorheological fluid which includes (1) a dispersed particulate phase of a polarizable solid material which conducts current along only one of its three axes; and (2) a continuous phase of a dielectric liquid. The Carlson electrorheological fluid operates in the absence of free water and is therefore suitable for use at temperatures at which water-containing electrorheological fluids cannot operate because of the evaporation of the water. The electrorheological fluid is also said to require a relatively low electric field strength. The preferred polarizable solid material is lithium hydrazine sulfate. However, a "stabilizer" is necessary to suspend the lithium hydrozinium sulfate which otherwise tends to settle out in the continuous phase. In the absence of this stabilizer, the lithium hydrozinium sulfate-based electrorheological fluid forms a heavy, flocculated grease. When too much stabilizer is added, the mixture separates into two layers: a sediment layer containing the lithium hydrozinium sulfate and a clear layer. While it is not clear from the Carlson patent, it is known that surfactants generally increase fluid conductivity resulting in resistive heating of the solution which reduces the electrorheological effect.

U.S. Pat. No. 4,744,914 to Filisko et al discloses an electrorheological fluid which may be used at temperatures in excess of 100° C. (typically about 120° C.) which includes (1) a non-conductive liquid phase; and (2) a crystalline zeolite particulate phase. The preferred zeolite is of the formula:

$$M_{x/n}[(AlO_2)_x(SiO_2)_y].wH_2O$$

where M is a metal cation or mixture of cations of valence n; x and y are integers and y/x is from about 1 to about 5; and w is a variable. The zeolites of Filisko are dried under vacuum at between about 250° to 350° C. and are not entirely water-free but the residual water does not evolve at operating temperatures. The examples indicate the use of the zeolite in concentrations of 10 and 16 g per 20 ml of liquid phase.

A recent patent, U.S. Pat. No. 4,812,251 to Stangroom, discloses an electrorheological fluid which includes a hydrophobic liquid component and a hydrophilic solid or discrete component. The liquid component is a fluorosilicone of average molecular weight in the range 200–700, while the preferred solid component is either a starch or silica gel. It may be an organic polymer having free or partially salified acid groups, a homo or copolymer of a monosaccharide or an alcohol, a wholly or partially salified copolymer of phenol and an aldehyde. Regardless of the nature of the solid component, the solid component should comprise from about 20 to about 60% of the electrorheological fluid by volume.

There yet exists a need for an electrorheological fluid that will operate at the relatively high temperatures encountered in commercial applications, while requiring a low electric field strength and wherein the discrete phase is present in low concentration.

SUMMARY OF THE INVENTION

The invention relates to electrorheological fluids (ERFs) which include a continuous liquid phase having a low dielectric constant and a discrete phase of layered mixed metal hydroxide (LMMH) particles. These LLMH-based ERFs are characterized in that they are heat stable, require a low concentration of the discrete phase, are responsive to low applied field strengths and provide a strong electrorheological response so that they may be usefully employed in a variety of applications.

While not wishing to be bound by any theory, it is speculated that the strong electrorheological response of the invention ERFs is due to, amongst others, the high surface area per unit of mass of the LMMH particles which enables the achievement of a high surface charge to mass ratio. LMMH particles can provide high aspect ratios, of the order of about 600:1.

The LMMHs useful in the invention ERFs may be prepared by the methods described in U.S. Pat. No. 4,790,954 to Burba et al and the European patent application published as EPO 0.207.811 to Burba et al, both of which are incorporated by reference as if fully set forth herein.

The continuous phase liquid generally includes those liquids having dielectric constants less than about 35 although liquids having higher dielectric constants may be used. Thus, the continuous phase may be selected from polyglycols, alcohols, hydrocarbons, halogenated hydrocarbons, mineral oils, silicone-based oils and greases, ethers and ketones and the like in either liquid, semi-solid or gel form.

While the LMMHs are readily dispersible in polar solvents such as alcohols, they are less readily dispersed in some of the non-polar liquids such as, for instance, mineral oils, which are desirable for use as the ERF continuous phase. It is speculated that this impaired dispersibility in non-polar liquids is due to the positive charge associated with the surface of the LMMH crystals. In order to nullify this charge effect, it is desirable to modify or functionalize the LMMH crystal surface. It has been found that this can be achieved in a variety of ways, for example, by treatment with a carboxylic or fatty acid, such as stearic acid, or by complexing with a negatively charged particle or crystal. The latter may be achieved, for instance, by combining a synthetic clay such as LAPONITE RDS (Laporte Industries, Ltd.) with an amine salt to aid in its dispersibility and then allowing the dispersed LAPONITE to combine with the LMMH thereby forming a complex which is readily dispersible in non-polar liquids.

The ERF composition may usefully vary from about 500 ppmw LMMH content up to about 20 wt. % when the LMMH is the only discrete phase component. Thus, the proportion of discrete phase component is lower than that required by prior art ERFs and this has significant repercussions in enhancing the usefulness of the invention ERFs. For instance, the relatively lower level of solids allows the use of the invention ERFs in applications where the use of large amounts of solid particles may be a limitation. Furthermore, the low solids concentration enables the production of ERFs having a lower apparent viscosity in the absence of an applied electric field so that the percentage change in apparent viscosity when an electric field is applied, is enhanced. Moreover, since solids are of greater density than the continuous phase, a low solids ERF is less dense thereby providing less total weight for a given volume; an attribute which is of significance in, for instance, space applications where weight is a major consideration.

The invention ERFs do not rely upon adsorbed water to provide or produce the electroheological effect and this contributes to their thermal stability. Due to this thermal stability and their powerful electrorheological response, the invention ERFs may be used, for example, in the automotive industry as clutch fluids in self-lubricating clutch systems, as clutch fluids in continuously variable transmissions and in shock absorbers. The ERFs may also find use in vibration or acoustic damping systems to disrupt shock or noise harmonics by continuously varying the "cushioning" properties (viscosity) of the ERF by varying the strength of the applied electric field. Thus, for example, the ERFs could be used as shock dampening nuclear power plant coolant pump mounts in nuclear submarines, shaft bearing mounts for submarines to provide silent, vibration free rotation, absorptive coatings against active sonar, active sound-absorbing partitions, building supports in earthquake-prone areas, etc. The invention ERFs may also be usefully employed in cushions, mattresses and seats to provide firmer or softer support as and where needed by suitably arranging the applied field in grids to achieve the desired end.

Thus, the invention LMMH-based ERFs which combine thermal stability, low solids concentration and strong electrorheological response are useful in a wider range of applications than heretofore possible with prior art ERFs.

DESCRIPTION OF THE PREFERRED EMBODIMENTS

Figure 1:
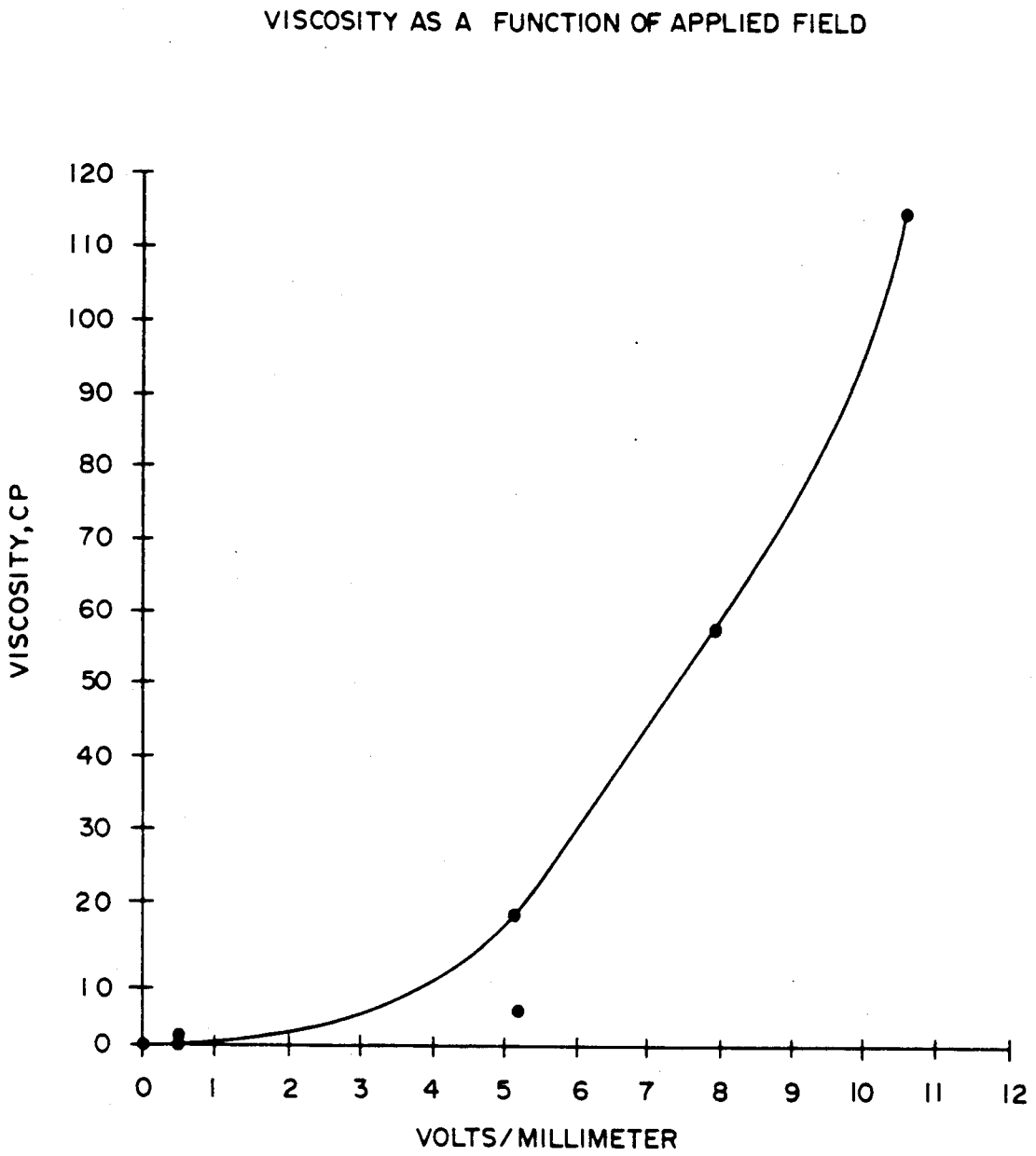
FIG. 1 is a graph of viscosity versus applied field for an ERF having about 2450 ppmw of LMMH.

The invention ERFs utilize particles or crystals of layered mixed metal hydroxides (LMMHs) as the discrete phase. These LMMHs may be represented by the formulae:

$$Mg_xAl_y(OH)_z, \quad \text{I and}$$

$$Li_mD_dT(OH)_{(m+2d+3+na)}A_a^n \quad \text{II}$$

where in Formula I:

x represents an average value of about 1.7, y represents an average value of about 0.5, and z represents an average value of about 5; and where in formula II:

m represents the number of Li ions present; D represents divalent metal ions; and d is the number of ions of D in the formula; T represents trivalent metal ions; A represents monovalent or polyvalent anions other than OH ions; a is the number of ions of A in the formula; n is the valence of A; and where (m+2d+3+na) is equal to or greater than 3. These layered mixed metal hydroxides are preferably prepared by an instantaneous ("flash") coprecipitation wherein soluble compounds, e.g. salts, of the metals are intimately mixed (using non-shearing agitation or mixing) with an alkaline material which supplies hydroxyl groups to form the mixed metal hydrous oxide crystals. A distinguishing feature of the present composition is that the crystals are essentially monolayer, or one layer of the mixed metal hydroxide per unit cell, which we call "monodispersed" crystals when they are in a liquid carrier, meaning that they are individual crystals of monolayer mixed metal hydroxides.

In the above formula, m may be from zero to about 1, most preferably 0.5 to about 0.75, when not zero.

The D metal may be Mg, Ca, Ba, Sr, Mn, Fe, Co, Ni, Cu, Zn, most preferably, Mg, Ca, or mixtures of these, and the value of d may be from zero to about 4, preferably about 1 to about 3 and most preferably about 1.

The T metal may be Al, Ga, Cr, or Fe, preferably Al and Fe, and most preferably Al.

The A anions may be monovalent, divalent, trivalent or polyvalent, and they may be inorganic ions such as halide, sulfate, nitrate, phosphate, carbonate, most preferably halide, sulfate, phosphate, or carbonate, or they may be hydrophilic organic ions such as glycolate, lignosulfonate, polycarboxylate, or polyacrylates. These anions often are the same as the anions which form part of the metal compound precursors from which these novel crystals are formed.

The alkoxide-based LMMHs shown in formula I and useful in the present invention may be prepared by the following general chemical reaction:

$$(M_1^{+x})(OC_yH_{2y+1})_x+(M_2^{+z})(OC_nH_{2n+1})_z+H_2O=M_1^{+x}M_2^{+z}(OH)_{x+z}+C_yH_{2y}OH+C_nH_{2n}OH \quad \text{(A)}$$

wherein:

$M_1$ is a divalent metal cation;

$M_2$ is a trivalent metal cation;

y is from 1 to 4;

and n is from 1 to 4.

The reaction is relatively slow and the total yield is limited by the extent of solubility of the metal alkoxides in alcohol or other solvents in which the reaction is carried out. As a general rule, a metal alkoxide is most soluble in its corresponding alcohol. However, solubility is only of the order of about 1 wt. % in most cases with the notable exception of magnesium ethoxide in ethanol.

The preparation of the formula I alkoxide-based LMMHs should be conducted in a moisture-free environment since the metal alkoxides are hygroscopic, reacting readily to form hydroxide, carbonate and alcohol. Consequently, the use of nitrogen-purged, moisture-free apparatus is recommended.

In general, two metal alkoxides in powder form are blended together and then added to dry alcohol in the approximate weight ratio alkoxide:alcohol 1:50. This mixture is stirred while heating to about 50° C. to obtain a solution which may still contain some undissolved solids. These solids may be separated by vacuum filtration. The filtrate is then treated with about two drops (0.06g) of deionized water for each 1 g of alkoxide while stirring. The filtrate obtained may be allowed to stand for from about 1 hours to about 48 hours. About 40–50% of the solvent is then evaporated, for instance, by flowing nitrogen to produce an LMMH-containing gel. In some instances a gel may form prior to the evaporation step, in which case this step may be eliminated.

In order to produce the more specific embodiment, $Mg_xAl_y(OH)_z$, the above procedure may be followed. It is preferred that the magnesium and aluminum ethoxides should be combined in methanol.

Methods for preparing the LMMHs of formula II above that are useful in the invention ERFs are disclosed in U.S. Pat. No. 4,750,954 to Burba et al which is incorporated in full by reference. The Burba patent indicates that in order to produce a LMMH, a mixture of the selected soluble metal compounds, especially the acid salts (e.g. chloride, nitrate, sulphate, phosphate, etc.) are dissolved in an aqueous carrier. The ratios of the metal ions in the solution are predetermined to give the ratios desired in the final product. The concentration limit of the metal compounds in the solution is governed, in part, by the saturation concentration of the least soluble of the metal compounds in the solution; any non-dissolved portions of the metal compounds may remain in the final product as a separate phase, which is not a serious problem, usually, if the concentration of such separate phase is a relatively low amount in comparison to the soluble portions, preferably not more than about 20% of the amount of soluble portions. The solution is then mixed rapidly and intimately with an alkaline source of $OH^-$ ions while substantially avoiding shearing agitation thereby forming monodispersed crystals of LMMH. One convenient way of achieving such mixing is by flowing the diverse feed streams into a mixing tee from which the mixture flows, carrying the reaction product, including the monodispersed LMMHs of the above formula I. The mixture may then be filtered, washed with fresh water to remove extraneous soluble ions (such as $Na^+$, $NH^+$ ions, and other soluble ions) which are not part of the desired product.

One method of preparing the formula II LMMH composition, however not exclusively the only method, is to react a solution of metal salts such as magnesium and aluminum salts (approximately 0.25 molar) with an appropriate base such as ammonia or sodium hydroxide in quantities sufficient to precipitate the LMMH. For ammonium hydroxide, the most preferable range is between about 1 and about 1.5 equivalents of $OH^-$ per equivalent of anion.

The precipitation should be done with little or no shear so that the resultant flocs are not destroyed. One method of accomplishing this is to flow two streams, the salt stream and the base stream, against one another so that they impinge in a low shear, converging zone such as would be found in a mixing tee. The reaction product is then filtered and washed, producing a filtercake of about 10% solids.

LMMHs may be prepared to obtain a relatively narrow distribution of particle sizes. It is believed that this has significant consequences since the electrorheological effect is believed to be proportional to both surface charge and the surface to mass ratio or aspect ratio. Consequently, high aspect ratios are desirable and LMMHs have aspect ratios generally ranging from about 30 to about 650 while aspect ratios of about 600 are readily obtained.

The continuous phase of the ERF comprises a liquid, semi-solid or gel composition and may be selected from those compositions having a low dielectric constant from about 40 to about 1, preferably less than about 35 and most preferably less than 5. These compositions include polyglycols, alcohols, polyols, hydrocarbons, halogenated hydrocarbons, mineral oils, silicone-based oils and greases, ethers, ketones and the like in either liquid, gel or semi-solid form. However, the continuous phase is preferably selected from mineral oils and is most preferably silicone-based oils. Operating factors such as, for instance, operating temperature, should be taken into account in selecting the continuous phase composition to optimize the ERF composition for particular applications.

As previously mentioned, the LMMH crystals are positively charged and are consequently less readily dispersed in non-polar than in polar fluids. Thus, when the LMMH is to form the sole component of the discrete phase, the choice of continuous phase is restricted to those in which the LMMH is dispersible up to the required weight proportion. However, it is often desirable to use as a continuous phase a solvent in which the LMMH is not readily dispersed. In this event, the LMMH may be modified to render it more readily dispersible. The modification may be effected by treating the LMMH crystals with a functionalizer, for example an aliphatic carboxylic or fatty acid, such as, for instance, stearic acid. Alternatively, steps may be taken to otherwise neutralize the LMMH crystal's surface charge. Such neutralization may be effected by combining the LMMH with a dispersible negatively-charged functionalizing species. For example, a synthetic clay such as LAPONITE, containing no free moisture, may be combined with an amine salt to form a composition that is readily dispersible in mineral oil. This clay-amine composition may then be combined with the LMMH crystals to form a complex that is readily dispersed in non-polar fluids thereby greatly expanding the range of fluids usable as the continuous phase of the invention ERFs. Furthermore, since these non-polar fluids are often the most desirable continuous phase fluids because of their low dielectric constants, the complexing or functionalizing of the LMMHs allows the production of ERFs having greater electrorheological response.

The discrete phase LMMH may be admixed with the continuous phase in such quantity as will produce the desired electrorheological response. These quantities may usefully range from about 0.05 wt. % to about 20 wt. % based upon the weight of the ERF. Preferably, the LMMH proportion should be in the range from about 0.1 wt. % to about 5 wt. % and most preferably in the range from about 0.5 wt. % to about 2.0 wt. %.

To produce the electrorheological effect, an electric field is applied to the ERF. For a given ERF composition, the electrorheological response is dependent upon the strength of the applied field. Clearly, however, for ERFs containing different quantities of LMMH or different LMMH compositions or having differing continuous phases, the electrorheological response will vary depending upon these factors. Thus, the selection of an ERF for a particular application requires a selection of LMMH composition, continuous phase composition, LMMH quantity, and electric field strength taking into account environmental factors such as, for instance, the temperature at which the ERF is expected to operate.

The advantages of the invention LMMH-based ERFs may be more readily appreciated by reference to the following non-limiting, illustrative examples.

The viscosities of the ERFs of Example 1 were measured using an apparatus which included a Brookfield Model LVF viscometer, a steel 6 oz. juice can with the inner epoxy lining removed and a Canberra Model 3002 power supply. The positive lead of the power supply was connected to the steel can. The negative lead of soft copper wire was wrapped around the shaft of the viscometer so as to provide continuous electrical contact but not to significantly hinder the rotation of the shaft. The viscometer spindle was located in the center of the can and was completely immersed in the fluid being tested such that the distance from the bottom of the spindle to the bottom of the can was greater than the distance from the spindle to the side of the can. The spindle was isolated from the viscometer drive mechanism by a latex rubber sleeve. For Examples 2–5, the ERF viscosity measurement apparatus as described above was used except that the juice can was replaced with a stainless steel cylindrical cup and the negative lead was a thin steel wire resting upon the shaft of the viscometer.

Example 1

An alkoxide gel was prepared by mixing magnesium ethoxide and aluminum ethoxide in dry methanol under moisture free conditions with subsequent water addition to produce an alkoxide-based LMMH gel. This provided a $Mg_xAl_y(OH)_z$ compound, as described before, which was relatively viscous at room temperature even though the concentration of the LMMH was only 1 wt. %.

An ERF was prepared by admixing 45.06 g of this alkoxide LMMH gel containing 1% LMMH with 138.89 g of anhydrous methanol This produced a composition containing 0.45 g LMMH or about 2450 ppmw.

The composition was placed in the apparatus described above and the viscosity measured at field strengths of 0, 10, 100 150, and 200 applied volts. Ten measurements were taken at each voltage level with a 20 second interval between measurements. Upon stepping up the field strength, the voltage and viscosity were allowed to equilibrate for 2-3 minutes before readings were taken at approximately 20 second intervals. To test the effect of current direction, the polarity was reversed at the 10 volt level. This reversal produced no significant change in the measured viscosity. The results of Example 1 are shown in FIG. 1.

EXAMPLE 2

A solution containing 3.0 g (0.004 moles) of the chloride salt of a monoquaternary amine (ARQUAD 2HT-75, Akzo Chemie America, 75% active) was prepared by dissolving the salt in a mixture of water (9 g), methanol (5 g), and isopropanol (4 g). A synthetic clay, LAPONITE RDS (Laporte Industries L.d.) which contains 6.0% pyrophosphate was then added to the amine solution and the resulting mixture was blended under high shear. The solvent was then removed by vacuum and residual solids were filtered and washed with distilled water. The washed solids (4.7 g) were dried and then mixed into mineral oil (55.4 g) at high shear for two minutes and thereafter shaken for 30 minutes. Upon testing this mixture, which contained about 7.8 wt. % solids based on the total weight of solids and oils, in an electric field, it showed no electrorheological response over the field strengths examined.

Figure 2:
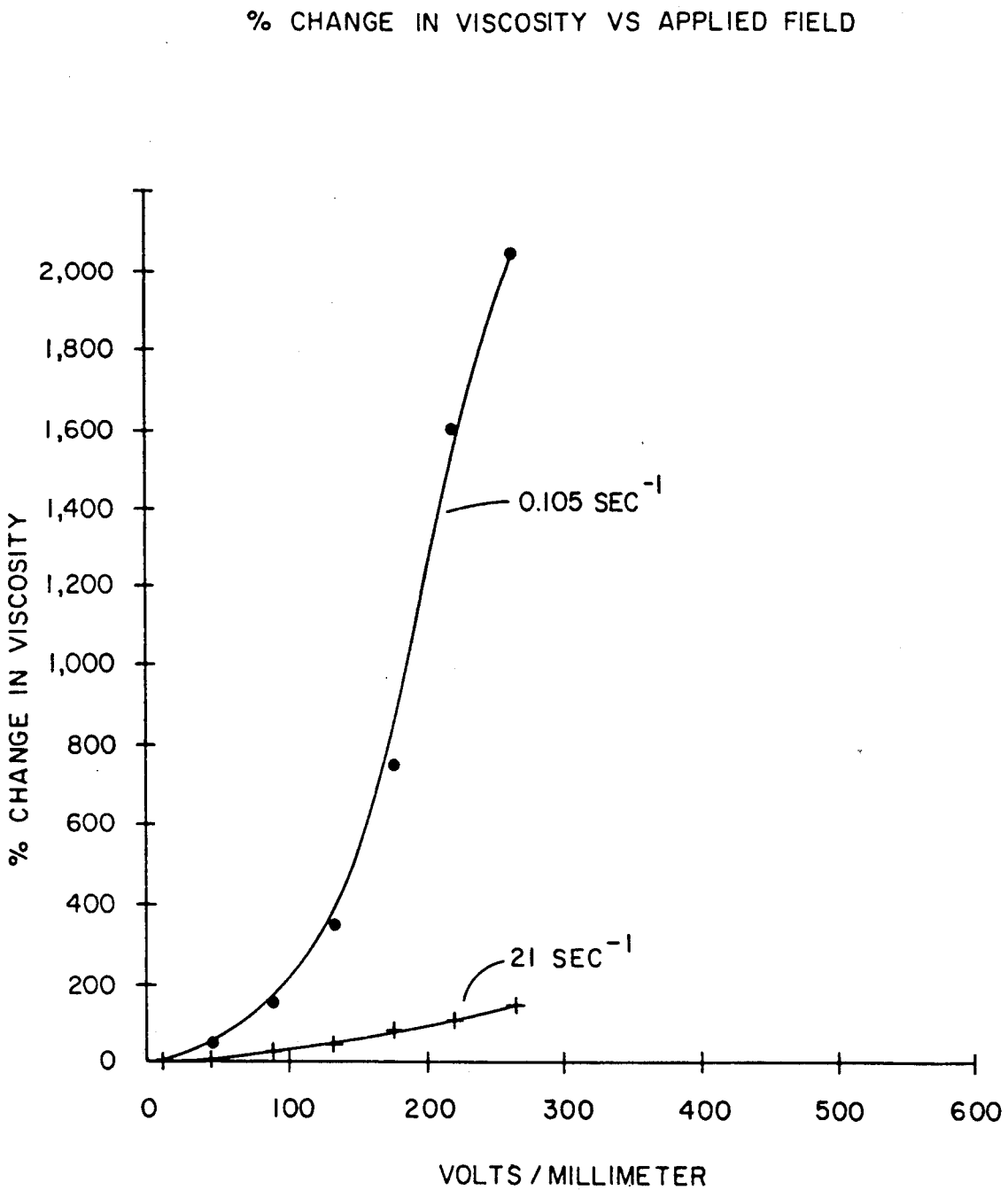
FIG. 2 is a graph of % change in viscosity versus applied field for a laponite-amine-mineral oil ERF and a laponite-amine-LMMH-mineral oil ERF.

The LAPONITE-amine-mineral oil mixture (60.1 g) was then blended at high shear with 50 g of $Mg_xAl_y(OH)_z$ LMMH gel (1.35 wt. % LMMH in methanol) to produce a milky fluid. The milky fluid was subjected to evaporation to remove the methanol. This resulted in a yellow, low viscosity mixture. The electrorheological response of this mixture at shear rates of 0.105 $sec^{-1}$ and 21 $sec^{-1}$ is shown in FIG. 2.

EXAMPLE 3

Figure 3:
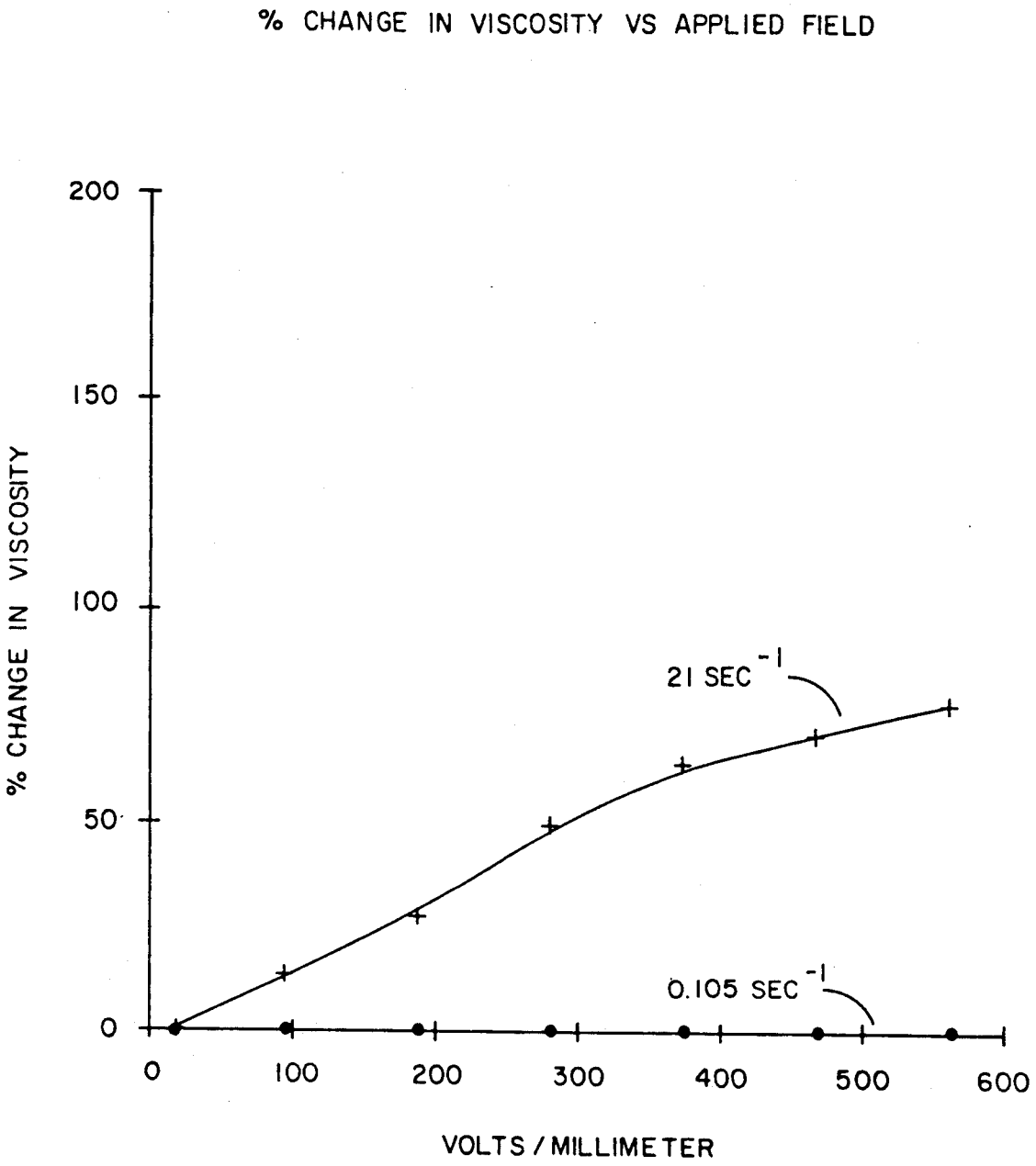
FIG. 3 is a graph of viscosity versus applied field for a LMMH in mineral oil ERF.

A clear solution containing 2.5 g (0.0088 moles) of stearic acid in acetone (40 g) was prepared To this solution was added 90.1 g of LMMH gel (1.33 wt. % LMMH in methanol) and the resultant mixture was thoroughly agitated. The solvents were then removed by vacuum and 3.91 g of white solids were recovered. The solids were dried at 120° C. for one hour yielding 3.66 g of dry white solids. After grinding, 3.4 g of solids were recovered, added to 56.6 g of mineral oil and blended under high shear for two minutes. Some solids were observed to settle out after about 30 minutes. The electrorheological response of this mixture at shear rates of 0.105 $sec^{-1}$ and 21 $sec^{-1}$ is shown in FIG. 3.

EXAMPLE 4

Figure 4:
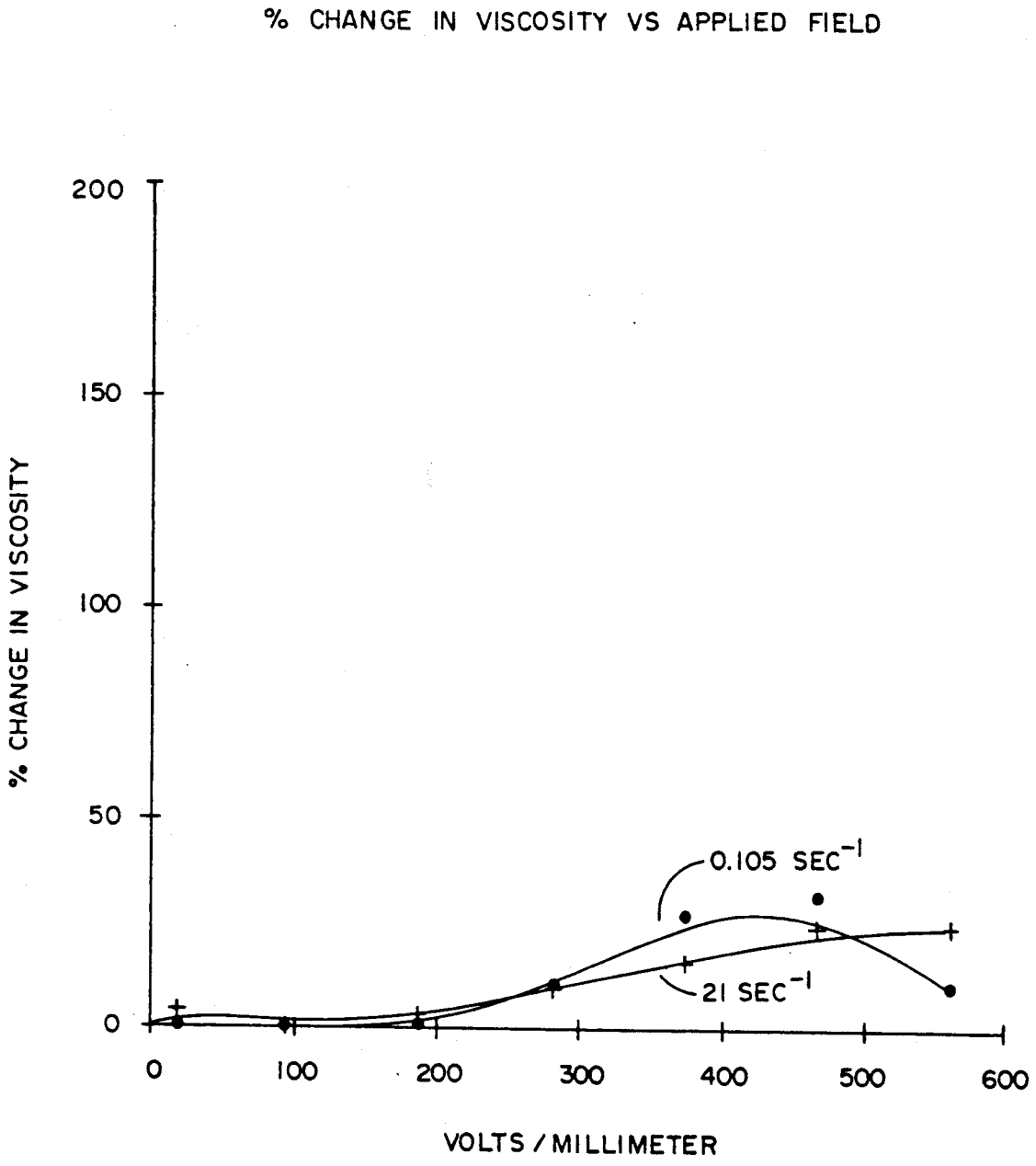
FIG. 4 is a graph of viscosity versus applied field for a laponite-amine-mineral oil ERF.

A solution of 5.12 g of (0.10 moles) of LAPONITE RDS in 100 cc of deionized water was prepared A second solution was prepared containing 7.5 g (0.010 moles) of 75% active ARQUAD 2HT-75 dissolved in 400 g of isopropanol. These two solutions were mixed together and the solvents removed by vacuum to recover 11.15 g of solids. The recovered solids were dried at 120° C. for 30 minutes and ground. The ground solids were then washed with one liter of deionized water and again dried at 120° C. for one hour yielding 10.4 g of white powder. The powder was dissolved in an isopropanol (400 g)-water (50 g) mixture to which 52 g of mineral oil were added Removal of the solvent resulted in the formation of 61.37 g of an almost-clear, thick, creamy gel. An additional 152 g of mineral oil was added to reduce the sample viscosity so that electrorheological readings could be taken. The final product contained 2.3 wt. % LAPONITE RDS, 2.54 wt.% ARQUAD 2HT-75, and 95.15 wt. % mineral oil, based upon the total product weight. The electrorheological response of this product at shear rates of 0.105 $sec^{-1}$ and 21 $sec^{-1}$ is shown in FIG. 4.

EXAMPLE 5

Figure 5:
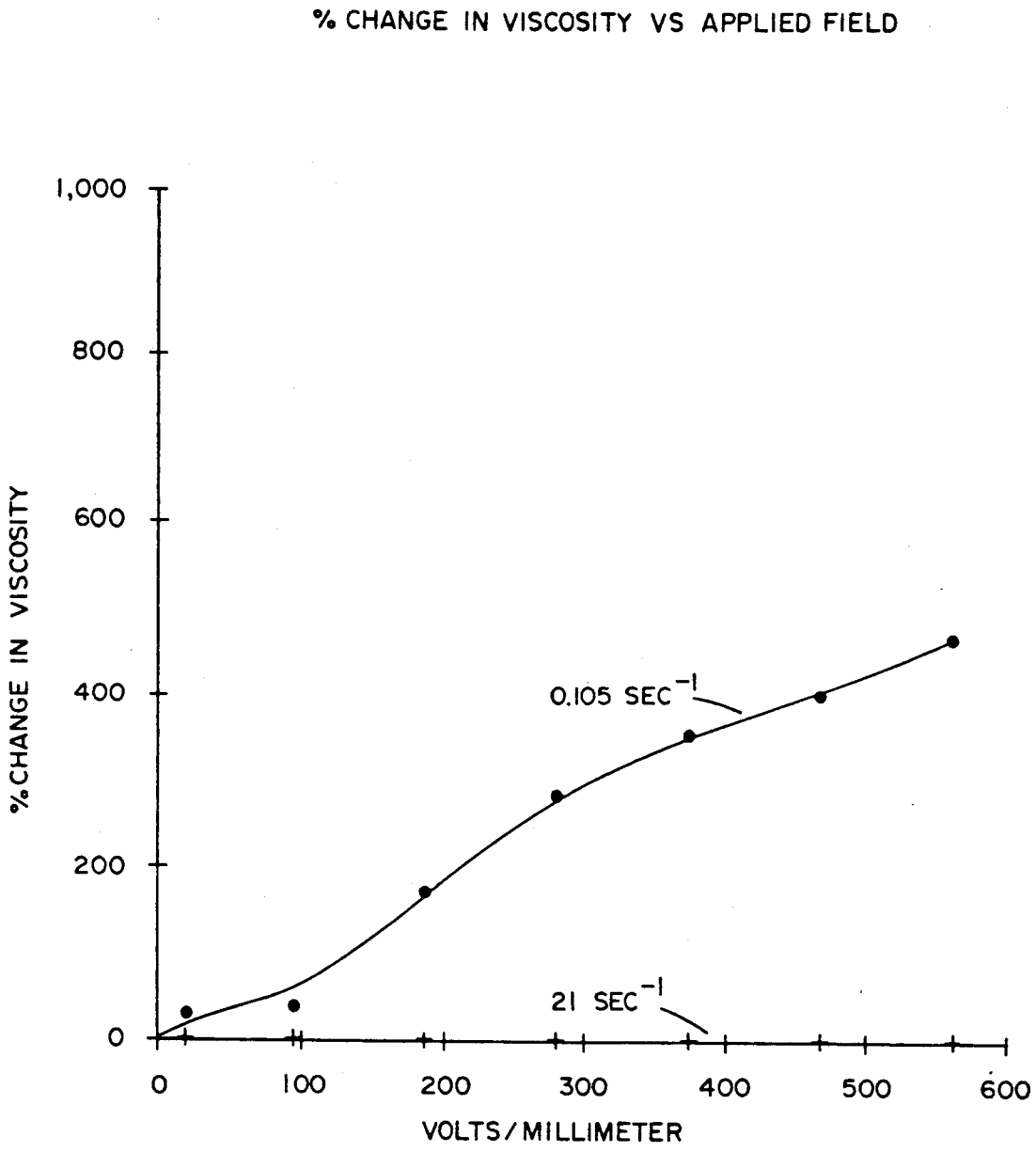
FIG. 5 is a graph of viscosity versus applied field for a LMMH-stearic-acid-mineral oil ERF.

A mixture was prepared by adding 58.3 g (0.005 moles) of LMMH gel (1.17 wt. % LMMH in methanol) to 58 g of mineral oil. The mixture was blended for 30 minutes under high shear. To this mixture, with stirring, was added 1.42 g (0.005 moles) of stearic acid dissolved in methanol. The solvent was removed under vacuum resulting in 58.9 g of clear, thick gel being recovered. An additional 60.0 g of oil was added and the mixture blended at high shear for two minutes in order to reduce the viscosity enough for the ER response to be measured The final composition of the sample was 0.57% LMMH, 1.18 wt. % stearic acid, 98.25 wt. % mineral oil. The electrorheological response at shear rates of 0.105 $sec^{-1}$ and 21 $sec^{-1}$ is shown in FIG. 5.

The results demonstrate that LMMH with stearic acid (Examples 3 and 5) has a better electrorheological response than LAPONITE(s) and ARQUAD 2HT-75 (Example 4) but not as good as the response of LMMH with LAPONITE and ARQUAD 2HT-75 (Example 2).

Although the invention has been described with reference to its preferred embodiments, those of ordinary skill in the art may, upon reading this disclosure, appreciate changes and modifications which do not depart from the scope and spirit of the invention as described above or claimed hereafter.

We claim:

1. A method of using an electrorheological fluid comprising:

(1) making an electrical contact across an electrorheological fluid comprising:

(a) a discrete phase comprising layered mixed metal hydroxide selected from the group consisting of:

$$Li_mD_dT(OH)_{(m+2d+e+na)}a_a^n$$

and $$Mg_xAl_y(OH)_z$$

wherein m is 0 to about 1;

D is a divalent metal ion selected from the group consisting of magnesium, calcium, barium, strontium, manganese, iron, cobalt, nickel copper and zinc;

d is 0 to about 4;

T is a metal ion selected from the group consisting of aluminum, gallium, chromium, and iron;

A is a monovalent or polyvalent ion other than an hydroxyl ion;

n is the valence of the anion A;

a is the number of anions A in the formula;

(m+2d+3+na) is equal to or greater than 3;

x is on average about 1.7;

y is on average about 0.5;

z is on average about 5; and (b) a low dielectric constant continuous phase; and (2) applying an electrical field across the electrorheological fluid.

2. The method of claim 1 wherein said layered mixed metal hydroxide is $Mg_{1.7}Al_{0.5}(OH)_5$.

3. The method of claim 2 wherein said continuous phase is mineral oil or silicone-based oil.

4. The method of claim 1 wherein said electrorheological fluid includes an amount of a functionalizer sufficient to disperse the layered mixed metal hydroxide in the continuous phase.

5. The method of claim 4 wherein said functionalizer is an aliphatic carboxylic acid.

6. The method of claim 1 wherein the discrete phase comprises a layered mixed metal hydroxide complexed with the reaction product of a negatively charged composition and the salt of an amine.

7. The method of claim 6 wherein the negatively charged composition is a clay.

8. The method of claim 1 wherein said low dielectric continuous phase is selected from the group consisting of alcohols, polyols, glycols, hydrocarbons, halogenated hydrocarbons, mineral oil, silicone-based oils and greases, aldehydes and ketones.

9. The method of claim 7 wherein the layered mixed metal hydroxide is complexed with the reaction product of LAPONITE and an amine salt.

10. The method of claim 1 wherein the layered mixed metal hydroxide comprises from about 0.05 wt % to about 20 wt % of the electrorheological fluid.

11. The method of claim 10 wherein the layered mixed metal hydroxide comprises from about 0.05 wt % to about 2.0 wt % of the electrorheological fluid.

* * * * *